US008830281B2

(12) United States Patent
Tsai et al.

(10) Patent No.: US 8,830,281 B2
(45) Date of Patent: Sep. 9, 2014

(54) CIRCUIT FOR COMPENSATING COLOR SHIFT OF A COLOR SEQUENTIAL DISPLAY METHOD AND METHOD THEREOF

(75) Inventors: Chi-Chung Tsai, Kinmen County (TW); Wen-Chih Tai, Hsinchu County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 198 days.

(21) Appl. No.: 13/237,955

(22) Filed: Sep. 21, 2011

(65) Prior Publication Data

US 2013/0027445 A1 Jan. 31, 2013

(30) Foreign Application Priority Data

Jul. 27, 2011 (TW) ..... 100126641 A

(51) Int. Cl.
*G09G 5/02* (2006.01)

(52) U.S. Cl.
CPC ..... *G09G 5/02* (2013.01)
USPC ..... 345/696

(58) Field of Classification Search
USPC ..... 345/696
See application file for complete search history.

(56) References Cited

U.S. PATENT DOCUMENTS 5,189,407 A * 2/1993 Mano et al. ..... 345/88

FOREIGN PATENT DOCUMENTS

| | | |
|---|---|---|
| TW | 503656 | 9/2002 |
| TW | I236656 | 7/2005 |
| TW | 200844502 | 11/2008 |
| TW | 200937385 | 9/2009 |
| TW | 201013236 | 4/2010 |
| TW | 201040924 | 11/2010 |

* cited by examiner

*Primary Examiner* — David D Davis
(74) *Attorney, Agent, or Firm* — Winston Hsu; Scott Margo

(57) ABSTRACT

A circuit for compensating color shift of a color sequential display method includes an image processing unit and a timing control circuit. The image processing unit includes a gray level generation unit, a pre-processing unit, and a color compensation unit. The gray level generation generates first gray levels of red, green, and blue sub-pixels. The pre-processing unit generates a pure color uniformity of a display panel and a color compensation value. The color compensation unit generates a color saturation of a pixel, a compensation difference of the pixel, and gray levels of red, green, and blue sub-pixels of a compensated pixel. The timing control circuit sequences the gray levels of the red, green, and blue sub-pixels of the compensated pixel according to the color sequential display method, and outputs the gray levels of the red, green, and blue sub-pixels of the compensated pixel to the display panel.

17 Claims, 12 Drawing Sheets

CIRCUIT FOR COMPENSATING COLOR SHIFT OF A COLOR SEQUENTIAL DISPLAY METHOD AND METHOD THEREOF

BACKGROUND OF THE INVENTION

1. Field of the Invention

The present invention is related to a compensation circuit and method thereof, and particularly to a compensation circuit and method thereof that can compensate color shift that occurs when performing a color sequential display method.

2. Description of the Prior Art

Utilizing a color sequential display method to display red, green, and blue light of a display panel eliminates the need for color filters to display the red, green, and blue light of the display panel. A color mix theory of the color sequential display method forms predetermined colors by rapidly switching backlight corresponding to the red, green, and blue light, so that red, green, and blue light sub-pixels are shown during a frame interval. Please refer to FIG. 1A, FIG. 1B, FIG. 1C, and FIG. 1D. FIG. 1A, FIG. 1B, FIG. 1C, and FIG. 1D are diagrams illustrating a pixel of a frame displaying red, green, blue, and white light, respectively. As shown in FIG. 1A, when the pixel displays the red light, a liquid crystal LCR corresponding to a red sub-pixel of the pixel of the frame is turned on (liquid crystals LCG and LCB corresponding to green and blue sub-pixels of the pixel of the frame are turned off). Thus, the pixel can display the red light, where backlights BLR, BLG, and BLB corresponding to the red, green, and blue sub-pixels are turned on. Similarly, as shown in FIG. 1B, when the pixel displays the green light, the liquid crystal LCG corresponding to the green sub-pixel of the pixel of the frame is turned on (the liquid crystals LCR and LCB corresponding to the red and blue sub-pixels of the pixel of the frame are turned off). Thus, the pixel can display the green light. Similarly, as shown in FIG. 1C, when the pixel displays the blue light, the liquid crystal LCB corresponding to the blue sub-pixel of the pixel of the frame is turned on (the liquid crystals LCR and LCG corresponding to the red and green sub-pixels of the pixel of the frame are turned off). Thus, the pixel can display the blue light. As shown in FIG. 1D, when the pixel displays the white light, the liquid crystals LCR, LCG, and LCB corresponding to the red, green, and blue sub-pixels are turned on. Thus, the pixel can display the white light.

Please refer to FIG. 2A and FIG. 2B. FIG. 2A is a diagram illustrating the liquid crystals LCR, LCG, and LCB corresponding to the red, green, and blue sub-pixels being turned on persistently, and FIG. 2B is a diagram illustrating the liquid crystal LCR corresponding to the red sub-pixel changing from turning-off to turning on. As shown in FIG. 2A, because the liquid crystals LCR, LCG, and LCB corresponding to the red, green, and blue sub-pixels are turned on persistently (that is, the liquid crystals LCR, LCG, and LCB are turned on completely), luminances of the red, green, and blue sub-pixels can be 100% (that is, luminance of the white sub-pixel can also be 100%). As shown in FIG. 2B, when the pixel displays the red light, the liquid crystal LCR corresponding to the red sub-pixel of the pixel changes from turning-off to turning on. However, due to insufficient response time of the liquid crystal LCR, the liquid crystal LCR is not turned on completely when the backlight BLR is turned on, resulting in the luminance of the red sub-pixel being lower than 100% (such as 70%). Please refer to FIG. 2C. FIG. 2C is a diagram illustrating the liquid crystals LCR, LCG, and LCB corresponding to the red, green, and blue sub-pixels changing from turning-off to turning on when the pixel displays the white light. As shown in FIG. 2C, when a liquid crystal control voltage VC changes from 0% to 100%, the liquid crystals LCR, LCG, and LCB corresponding to the red, green, and blue sub-pixels change from turning-off to turning on. However, due to insufficient response time of the liquid crystals LCR, LCG, and LCB, the luminances of the red, green, and blue sub-pixels are different (such as 50%, 95%, 100%). As shown in FIG. 2C, duty cycles of the backlights BLR, BLG, and BLB corresponding to the red, green, and blue sub-pixels are 75%. Thus, the display panel may exhibit uneven color levels.

Please refer to FIG. 3A and FIG. 3B. FIG. 3A and FIG. 3B are diagrams illustrating the prior art solution to the problem of the uneven color levels of the display panel. As shown in FIG. 3A, the prior art utilizes shorter turning-on time of the backlights BLR, BLG, and BLB to solve the problem of the uneven color levels of the display panel, where the luminances of the red, green, and blue sub-pixels can reach 80%, 99%, and 100%, respectively. However, because the turning-on times of the backlights BLR, BLG, and BLB are shorter (the duty cycles of the backlights BLR, BLG, and BLB are 25%), the instantaneous luminances of the red, green, and blue sub-pixels must be increased to meet luminance requirements of the display panel, resulting in instantaneous output power being too high. In addition, as shown in FIG. 3B, the prior art inserts a black frame before each sub-pixel, so start points of the all color levels of the display panel are the same. But, as shown in FIG. 3B, the prior art reduces greatly the luminances of the red, green, and blue sub-pixels (such as 40%, 40%, and 40%). Therefore, the above mentioned prior arts for solving the problem of the uneven color levels of the display panel are not good choices for a designer of the display panel.

SUMMARY OF THE INVENTION

An embodiment provides a circuit for compensating color shift of a color sequential display method. The circuit includes an image processing unit and a timing control circuit. The image processing unit is used for compensating gray levels of red, green, and blue sub-pixels of a pixel to generate gray levels of red, green, and blue sub-pixels of a compensated pixel. The image processing unit includes a gray level generation unit, a pre-processing unit, and a color compensation unit. The gray level generation unit is used for generating first gray levels of red, green, and blue sub-pixels. The pre-processing unit is used for generating a pure color uniformity of a display panel according to maximum luminances of red light, green light, blue light, and white light displayed by the display panel, and generating a color compensation value according to the pure color uniformity. The color compensation unit is coupled to the pre-processing unit and the gray level generation unit for generating color saturation of the pixel according to the first gray levels of the red, green, and blue sub-pixels generated by the gray level generation unit, generating a compensation difference of the pixel according to the color saturation and the color compensation value, and generating the gray levels of the red, green, and blue sub-pixels of the compensated pixel according to the compensation difference and the first gray levels of the red, green, and blue sub-pixels. The timing control circuit is coupled to the image processing unit for sequencing the gray levels of the red, green, and blue sub-pixels of the compensated pixel according to the color sequential display method, and outputting the gray levels of the red, green, and blue sub-pixels of the compensated pixel to the display panel. The display panel displays the compensated pixel according to the sequenced gray levels of the red, green, and blue sub-pixels of the compensated pixel.

Another embodiment provides a circuit for compensating color shift of a color sequential display method. The circuit includes a timing control circuit and an image processing unit. The timing control circuit is used for sequencing gray levels of red, green, and blue sub-pixels of a pixel according to the color sequential display method. The image processing unit is coupled to the timing control circuit for generating compensation gray level values of red, green, and blue sub-pixels of a pixel. The image processing unit includes a pre-processing unit and a color compensation unit. The pre-processing unit is used generating a pure color uniformity of a display panel according to maximum luminances of red light, green light, blue light, and white light displayed by the display panel. The color compensation unit is coupled to the pre-processing unit for generating compensation gray level values of the red, green, and blue sub-pixels of the pixel according to the pure color uniformity, a gray level of one sub-pixel of the pixel, and a compensation gray level value of a previous sub-pixel corresponding to the sub-pixel of the pixel. The display panel displays the compensated pixel according to the compensation gray level values of the red, green, and blue sub-pixels of the pixel.

Another embodiment provides a method for compensating color shift of a color sequential display method. The method includes a pre-processing unit generating a pure color uniformity of a display panel according to maximum luminances of red light, green light, blue light, and white light displayed by the display panel; the pre-processing unit generating a color compensation value according to the pure color uniformity; a gray level generation unit generating first gray levels of red, green, and blue sub-pixels; a color compensation unit generating a color saturation corresponding to a pixel according to the first gray levels of red, green, and blue sub-pixels; the color compensation unit generating a compensation difference corresponding to the pixel according to the color saturation and the color compensation value; the color compensation unit generating gray levels of red, green, and blue sub-pixels of a compensated pixel according to the compensation difference and the first gray levels of red, green, and blue sub-pixels; a timing control circuit sequencing the gray levels of the red, green, and blue sub-pixels of the compensated pixel according to the color sequential display method, and outputting the gray levels of the red, green, and blue sub-pixels of the compensated pixel to the display panel; and the display panel displaying the compensated pixel according to the sequenced gray levels of the red, green, and blue sub-pixels of the compensated pixel.

Another embodiment provides a method for compensating color shift of a color sequential display method. The method includes a pre-processing unit generating a pure color uniformity of a display panel according to maximum luminances of red light, green light, blue light, and white light displayed by the display panel; a timing control circuit sequencing gray levels of red, green, and blue sub-pixels of a pixel according to the color sequential display method; a color compensation unit determining whether a product of the pure color uniformity and a gray level of one sub-pixel of the pixel is greater than a compensation gray level value of a previous sub-pixel corresponding to the sub-pixel of the pixel; and the color compensation unit generating a compensation gray level value of the sub-pixel of the pixel according to a determination result.

The present invention provides a circuit for compensating a color shift of the color sequential display method and method thereof. The circuit and method thereof adjust gray levels of a pixel according to color saturation of the pixel, and maximum luminances of red light, green light, blue light, and white light of a display panel. Therefore, the present invention can solve a problem of uneven color levels of the display panel due to insufficient response time of liquid crystals of the display panel.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 2B is a diagram illustrating the liquid crystal corresponding to the red sub-pixel changing from turning-off to turning on.

DETAILED DESCRIPTION

Figures 1A, 1B, 1C, 1D:
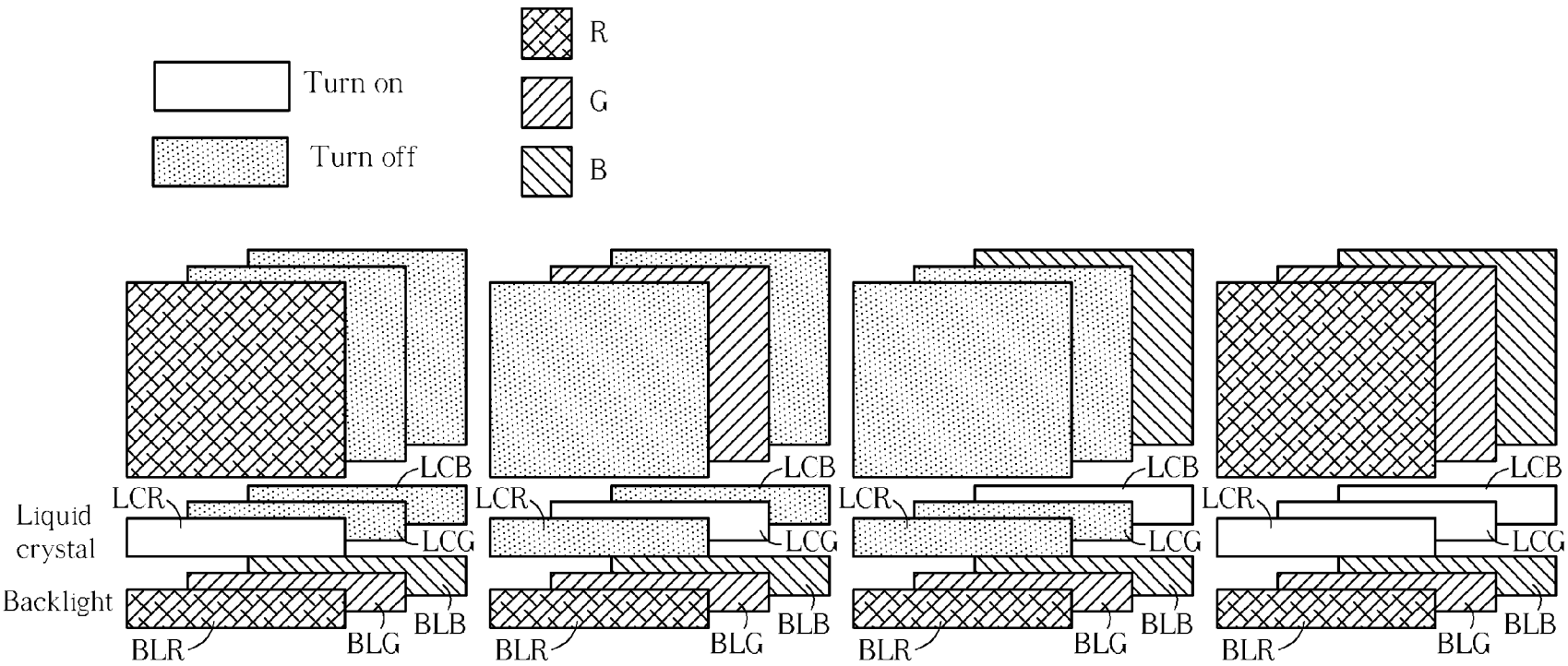
FIG. 1A PRIOR ART
FIG. 1B PRIOR ART
FIG. 1C PRIOR ART
FIG. 1D PRIOR ART
FIG. 1A, FIG. 1B, FIG. 1C, and FIG. 1D are diagrams illustrating a pixel of a frame displaying red, green, blue, and white light, respectively.
Figure 2B:
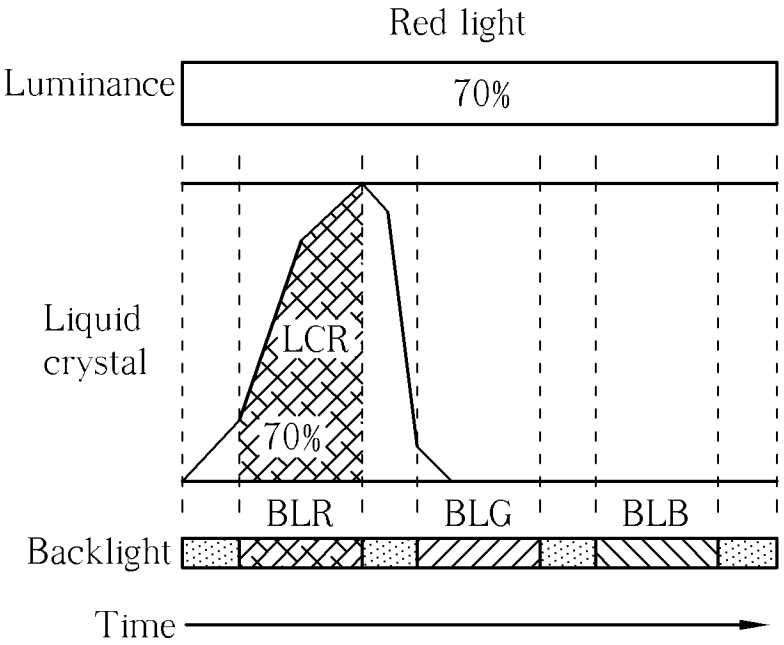
FIG. 2B PRIOR ART
Figure 2A:
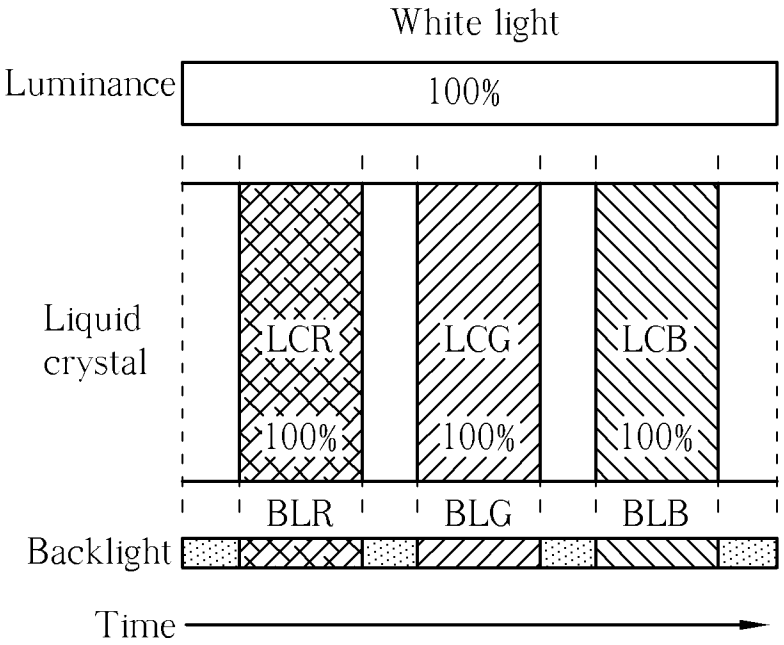
FIG. 2A PRIOR ART
FIG. 2A is a diagram illustrating the liquid crystals corresponding to the red, green, and blue sub-pixels being turned on persistently.
Figure 2C:
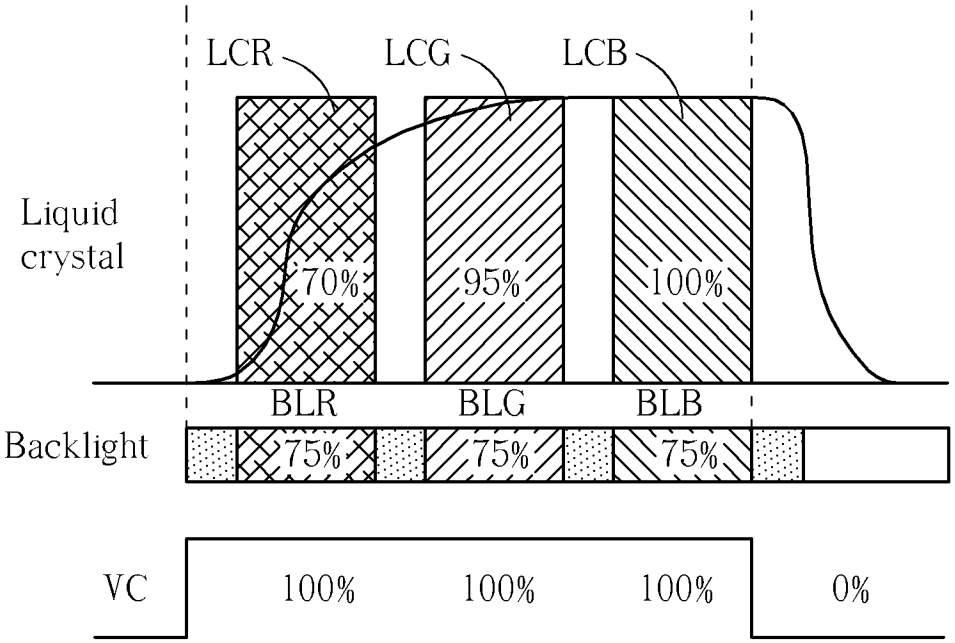
FIG. 2C PRIOR ART
FIG. 2C is a diagram illustrating the liquid crystals corresponding to the red, green, and blue sub-pixels changing from turning-off to turning on when the pixel displays the white light.
Figure 3B:
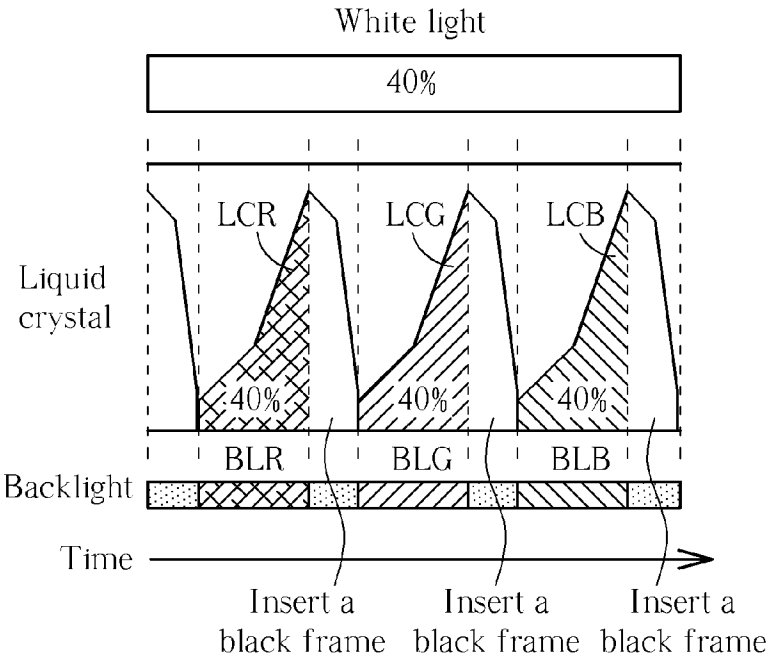
FIG. 3B PRIOR ART
FIG. 3A and FIG. 3B are diagrams illustrating the prior art solving the problem of the uneven color levels of the display panel.
Figure 3A:
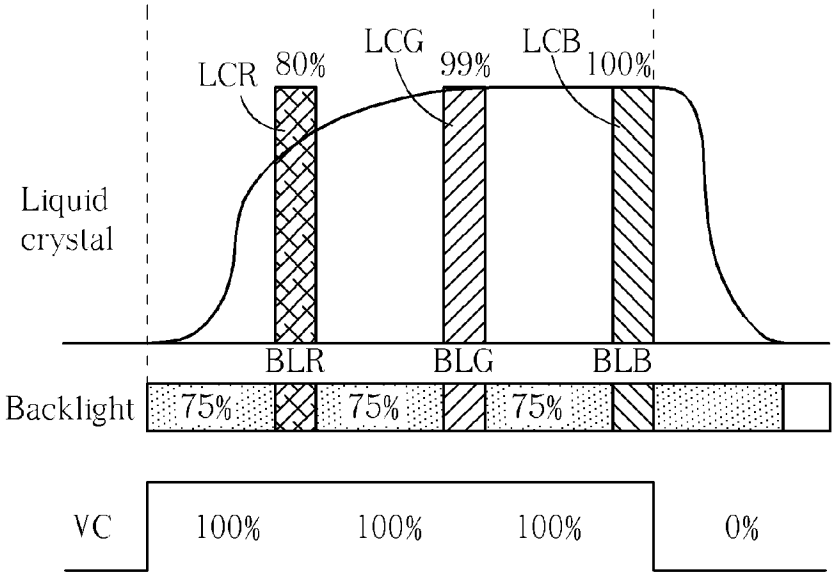
FIG. 3A PRIOR ART
Figure 4:
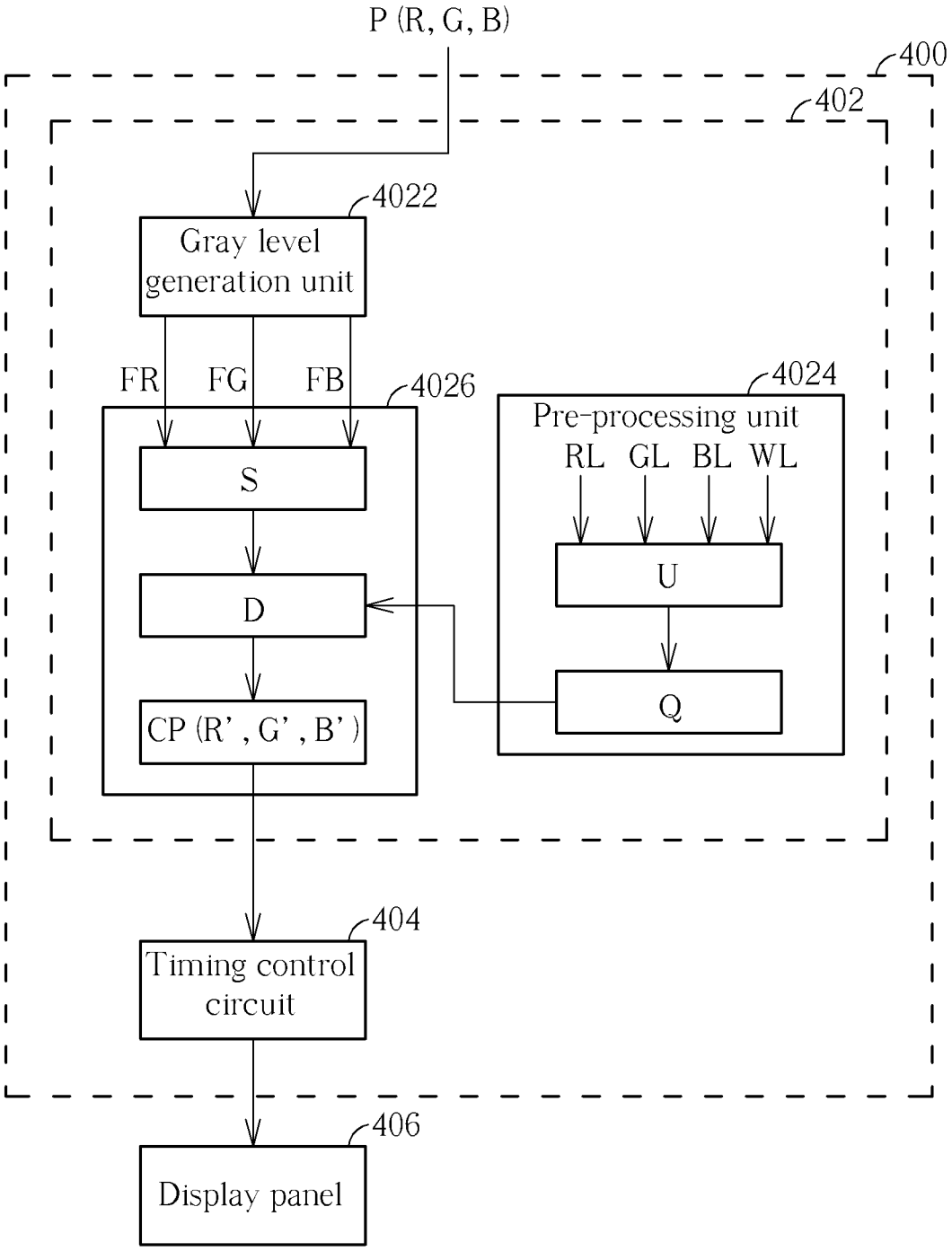
FIG. 4 is a diagram illustrating a circuit for compensating color shift of a color sequential display method according to an embodiment.

Please refer to FIG. 4. FIG. 4 is a diagram illustrating a circuit 400 for compensating color shift that occurs when performing a color sequential display method according to an embodiment. The circuit 400 includes an image processing unit 402 and a timing control circuit 404, where the image processing unit 402 includes a gray level generation unit 4022, a pre-processing unit 4024, and a color compensation unit 4026. The color compensation unit 4026 is coupled to the pre-processing unit 4024 and the gray level generation unit 4022. The image processing unit 402 is used for compensating gray levels of red, green, and blue sub-pixels R, G, and B of a pixel P to generate gray levels of red, green, and blue sub-pixels R', G', and B' of a compensated pixel CP. The timing control circuit 404 is coupled to the image processing unit 402 for sequencing the gray levels R', G', and B' of the red, green, and blue sub-pixels of the compensated pixel CP according to a color sequential display method, and outputting the gray levels R', G', and B' of the red, green, and blue sub-pixels of the compensated pixel CP to a display panel 406. The display panel 406 displays the compensated pixel CP according to the sequenced gray levels R', G', and B' of the red, green, and blue sub-pixels of the compensated pixel CP.

As shown in FIG. 4, before the gray levels of the red, green, and blue sub-pixels R, G, B of the pixel P are compensated, the pre-processing unit 4024 is used for generating pure color uniformity U of the display panel 406 according to maximum luminance RL, GL, BL, and WL of red light, green light, blue light, and white light displayed by the display panel 406, and equation (1), and generating a color compensation value Q according to the pure color uniformity U and equation (2):

$$U = \frac{RL + GL + BL}{WL} \tag{1}$$

$$Q = 1 - U \tag{2}$$

As shown in equation (1), RL, GL, BL, and WL are the maximum luminance of the red light, green light, blue light, and white light displayed by the display panel 406, respectively. But, the present invention is not limited to utilizing equation (1) to generate the pure color uniformity U, and utilizing equation (2) to generate the color compensation value Q. For example, when the display panel 406 displays red light, maximum luminance of the red light is 70%; when the display panel 406 displays white light, maximum luminance of the red light in the white light is 100%. Therefore, pure color uniformity U of the red light of the display panel 406 is 70% according to equation (1). Then, the pre-processing unit 4024 can utilize equation (2) and the pure color uniformity U of the red light to generate a color compensation value Q corresponding to the red light. Similarly, the pre-processing unit 4024 can also utilize equation (1) and equation (2) to generate pure color uniformity and a color compensation value corresponding to the green light, and pure color uniformity and a color compensation value corresponding to the blue light. In another embodiment of the present invention, the pre-processing unit 4024 can exclude repeat calculation of black frames according to equation (3):

$$U = \frac{RL + GL + BL - 3K}{WL - K} \tag{3}$$

As shown in equation (3), K is luminance corresponding to the black frame. In general, if contrast of the display panel 406 is higher, the luminance K corresponding to the black frame may be low enough to be ignored.

As shown in FIG. 4, the gray level generation unit 4022 generates first gray levels FR, FG, and FB of the red, green, and blue sub-pixels according to the pixel P received by the image processing unit 402. In FIG. 4, the first gray levels FR, FG, and FB of the red, green, and blue sub-pixels are equal to the gray levels of red, green, and blue sub-pixels R, G, and B of the pixel P. Then, the color compensation unit 4026 generates color saturation S corresponding to the pixel P according to equation (4) and the first gray levels FR, FG, and FB of the red, green, and blue sub-pixels:

$$S = \frac{\max(FR, FG, FB)}{\mathrm{sum}(FR, FG, FB)} \tag{4}$$

As shown in equation (4), Max(FR, FG, FB) is the maximum gray level of the first gray levels FR, FG, and FB of the red, green, and blue sub-pixels generated by the level generation unit 4022. But, the present invention is not limited to utilizing equation (4) to generate the color saturation S corresponding to the pixel P. For example, gray levels of a pixel with pure red light are (255, 0, 0), so color saturation of the pixel with the pure red light is 1 (that is, S=255/255=1). In addition, gray levels of a pixel with white light are (255, 255, 255), so color saturation of the pixel with the white light is 0.33 (that is, S=255/(255+255+255)=0.33). Therefore, as shown in equation (4), the color saturation S is between 0.33 and 1.

As shown in equation (4), the color compensation unit 4026 generates a compensation difference D according to equation (5), the color compensation value Q corresponding to the pixel P, and the color saturation S corresponding to the pixel P. Then, the color compensation unit 4026 generates the gray levels of the red, green, and blue sub-pixels R', G', and B' of the compensated pixel CP according to equation (6) and the compensation difference D corresponding to the pixel P. But, the present invention is not limited to utilizing equation (5) to generate the compensation difference D corresponding to the pixel P, and utilizing equation (6) to generate the gray levels of red, green, and blue sub-pixels R', G', and B' of the compensated pixel CP.

$$D = Q \times (1 - S) \times C \tag{5}$$

$$R' = FR \times (1 - D)$$

$$G' = FG \times (1 - D)$$

$$B' = FB \times (1 - D) \tag{6}$$

As shown in equation (5), C is a constant value chosen by a user. If C is equal to 1, equation (6) can be rewritten to equation (7):

$$R' = FR \times (1 - D) = FR \times (1 - (1 - U) \times (1 - S))$$

$$G' = FG \times (1 - D) = FG \times (1 - (1 - U) \times (1 - S))$$

$$B' = FB \times (1 - D) = FB \times (1 - (1 - U) \times (1 - S)) \tag{7}$$

Because color saturation S of pure color light (red light, green light, blue light) is equal to 1, equation (7) can be rewritten as equation (8) for a pixel with the pure color light:

$$R' = FR$$

$$G' = FG$$

$$B' = FB \tag{8}$$

As shown in equation (8), the color compensation unit 4026 does not compensate a pixel with the pure color light. As shown in equation (7), equation (7) can be rewritten as equation (9) for a pixel with white light, where the pure color uniformity U of the display panel 406 is 70%, and color saturation S of the white light of the display panel 406 is 0.33.

$$R'=FR\times(1-D)=FR\times(1-(30\%)\times(0.67))\approx FR\times 0.8$$

$$G'=FG\times(1-D)=FG\times(1-(30\%)\times(0.67))\approx FR\times 0.8$$

$$B'=FB\times(1-D)=FB\times(1-(30\%)\times(0.67))\approx FR\times 0.8 \quad (9)$$

As shown in equation (9), the color compensation unit 4026 compensates 20% for the pixel with the white light. That is to say, luminance of the pixel with the white light changes from 100% to 80%. Similarly, if C is equal to 1.5, the luminance of the pixel with the white light changes from 100% to 70%. That is to say, the luminance of the pixel with the white light is equal to luminance of the pixel with the pure color light.

Figure 5:
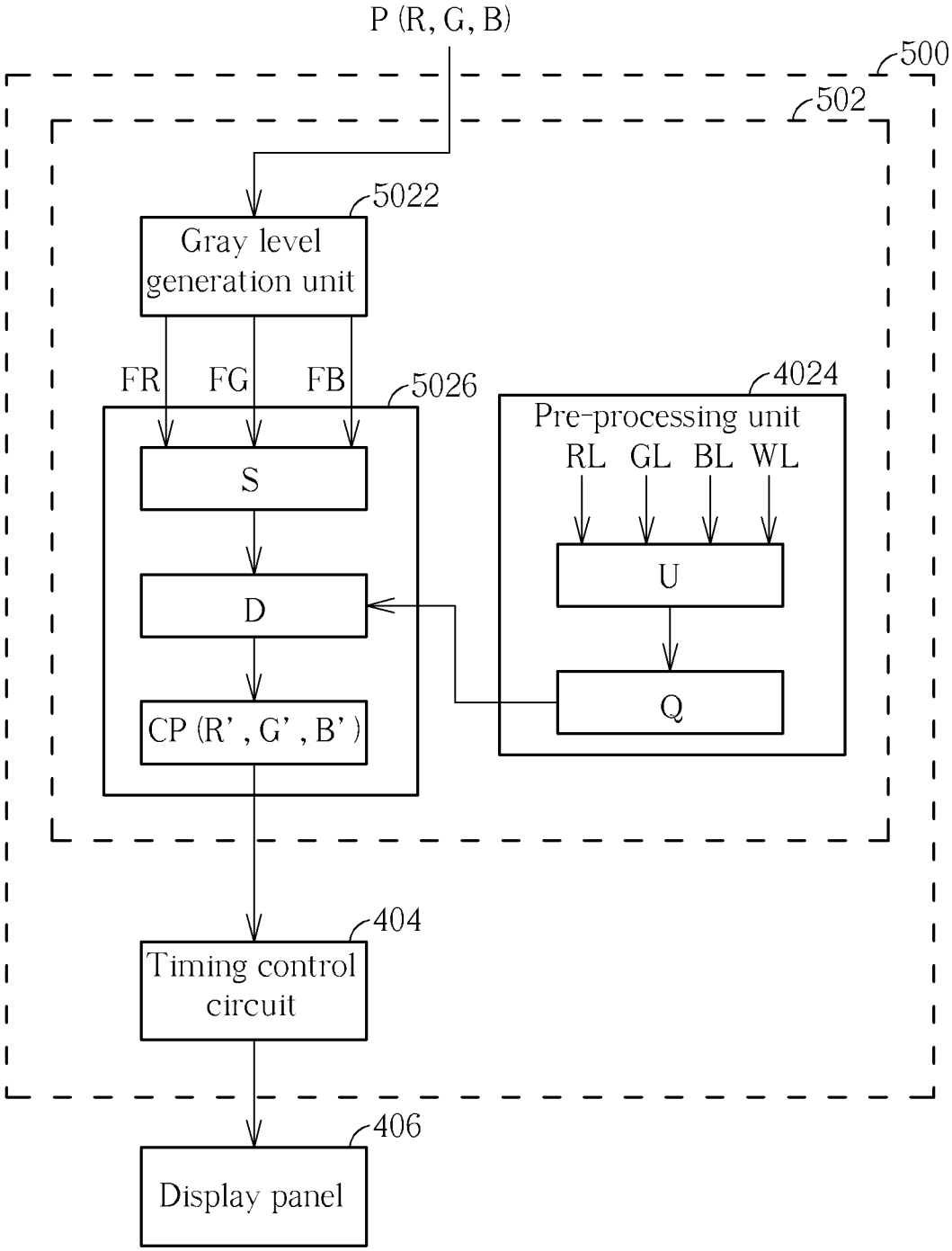
FIG. 5 is a diagram illustrating a circuit for compensating color shift of a color sequential display method according to another embodiment.

Please refer to FIG. 5. FIG. 5 is a diagram illustrating a circuit 500 for compensating color shift that occurs when performing a color sequential display method according to another embodiment. In the circuit 500, a gray level generation unit 5022 of an image processing unit 502 generates first gray levels FR, FG, and FB of red, green, and blue sub-pixels according to a pixel P received by the image processing unit 502, and equation (10):

$$FR=\left(\frac{R}{255}\right)^{\gamma} \quad (10)$$

$$FG=\left(\frac{G}{255}\right)^{\gamma}$$

$$FB=\left(\frac{B}{255}\right)^{\gamma}$$

As shown in equation (10), R, G, and B are gray levels of red, green, and blue sub-pixels of the pixel P, and γ is 2.2. But, the present invention is not limited to γ being 2.2. In addition, as shown in FIG. 5, a color compensation unit 5026 of the image processing unit 502 generates gray levels of red, green, and blue sub-pixels R', G', and B' of a compensated pixel CP according to equation (11), the first gray levels FR, FG, and FB of the red, green, and blue sub-pixels generated by the gray level generation unit 5022, and a compensation difference D:

$$R'=[FR\times(1-D)]^{\left(\frac{1}{\gamma}\right)}\times 255 \quad (11)$$

$$G'=[FG\times(1-D)]^{\left(\frac{1}{\gamma}\right)}\times 255$$

$$B'=[FB\times(1-D)]^{\left(\frac{1}{\gamma}\right)}\times 255$$

As shown in FIG. 5, the circuit 500 can correct influence of the human eye caused by γ. Further, subsequent operational principles of the circuit 500 are the same as those of the circuit 400, so further description thereof is omitted for simplicity.

Figure 6:
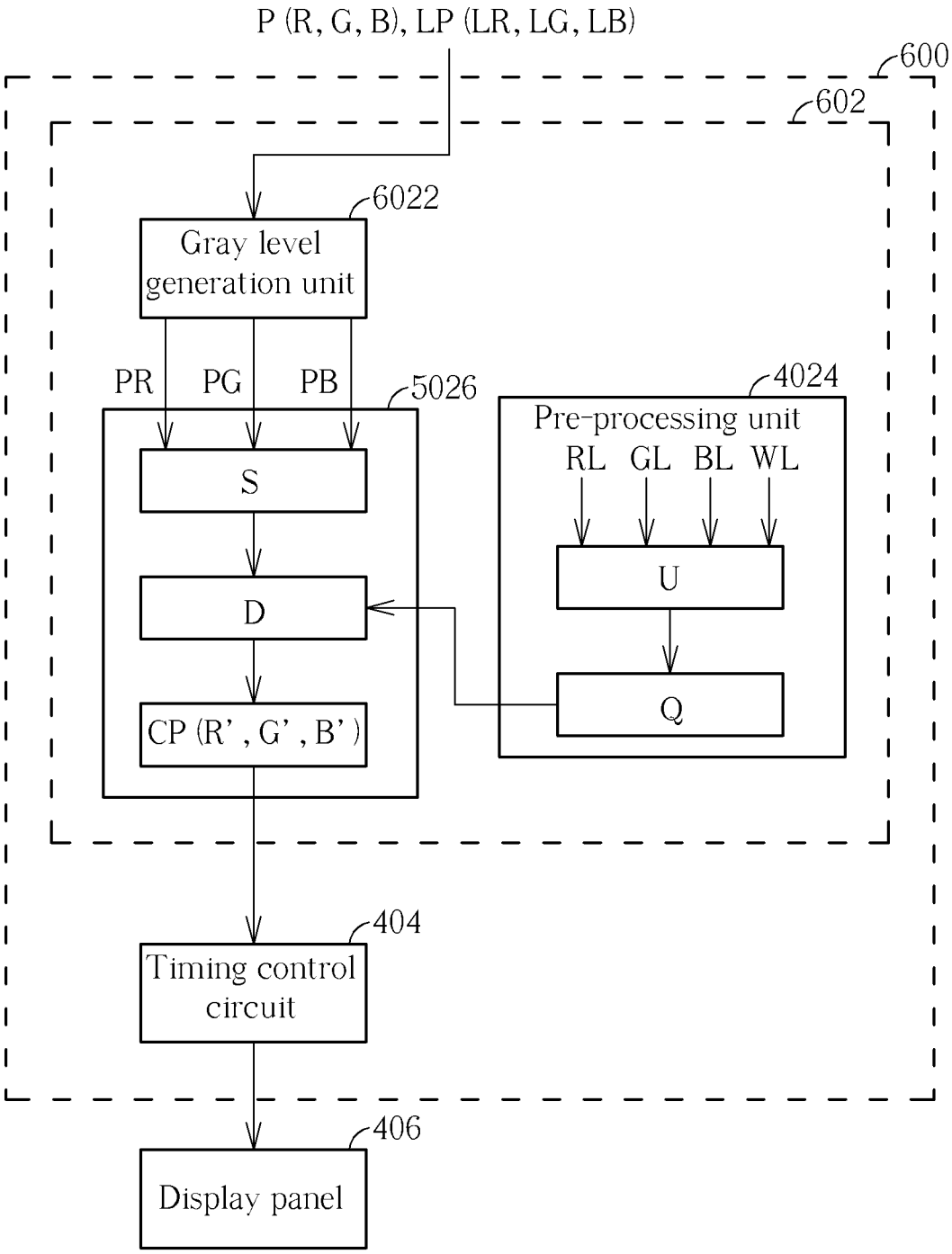
FIG. 6 is a diagram illustrating a circuit for compensating color shift of a color sequential display method according to another embodiment.

Please refer to FIG. 6. FIG. 6 is a diagram illustrating a circuit 600 for compensating color shift that occurs when performing a color sequential display method according to another embodiment. A difference between the circuit 600 and the circuit 500 is that a gray level generation unit 6022 of the circuit 600 utilizes a gray level R of a red sub-pixel of a pixel P and gray levels LG, LB of green, and blue sub-pixels of a previous pixel LP to act as a gray level PR of red light for calculating color saturation S, the gray level R of the red sub-pixel of the pixel P, a gray level G of a green sub-pixel of the pixel P, and the gray level LB of the blue sub-pixels of the previous pixel LP to act as a gray level PG of green light for calculating the color saturation S, and the gray level R of the red sub-pixel of the pixel P, the gray level G of the green sub-pixel of the pixel P, and a gray level B of a blue sub-pixel of the pixel P to act as a gray level PB of blue light for calculating the color saturation S according to the pixel P and the previous pixel LP corresponding to the pixel P received by the image processing unit 602. Further, subsequent operational principles of the circuit 600 are the same as those of the circuit 500, so further description thereof is omitted for simplicity.

Figure 7:
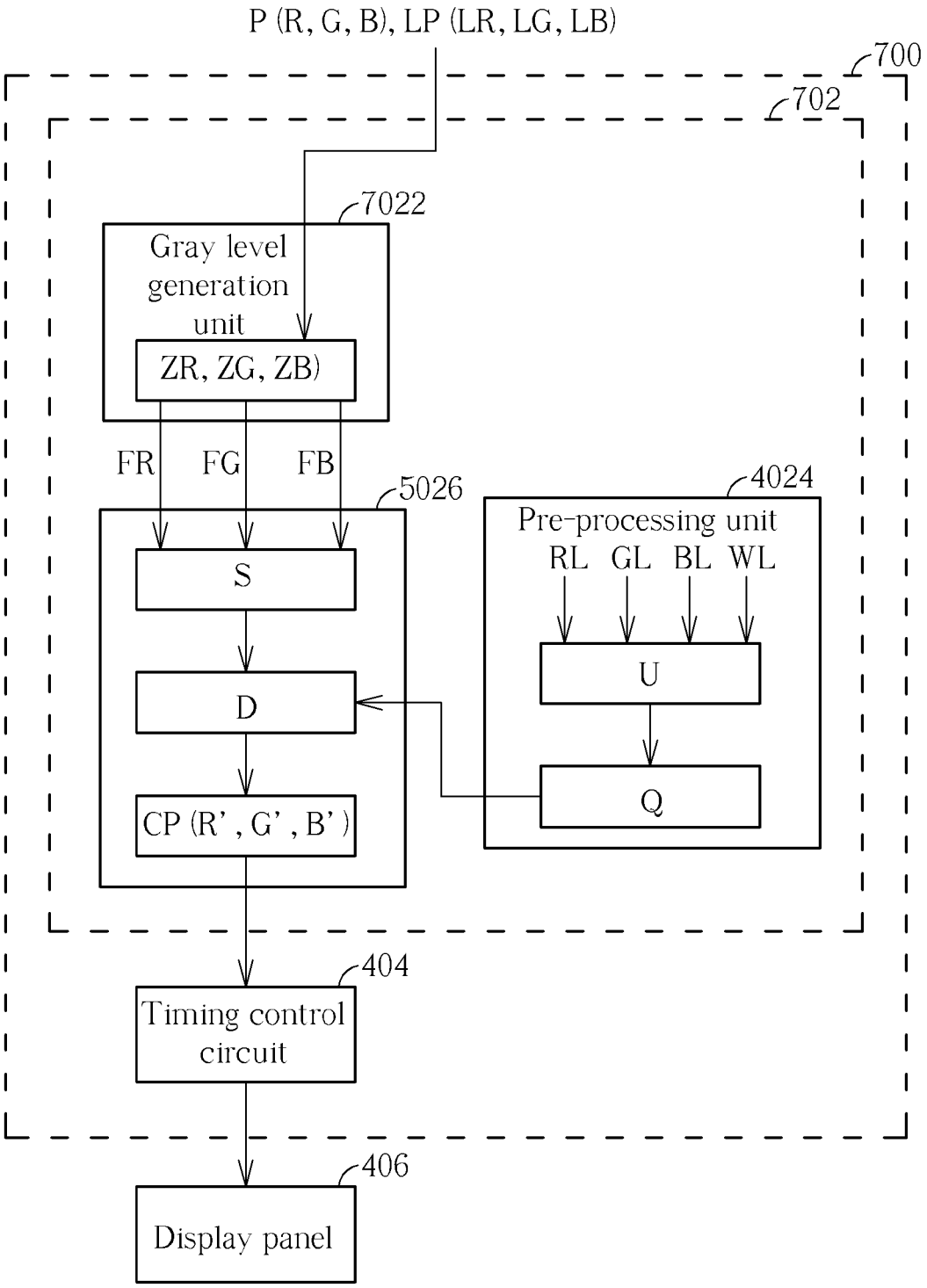
FIG. 7 is a diagram illustrating a circuit for compensating color shift of a color sequential display method according to another embodiment.

Please refer to FIG. 7. FIG. 7 is a diagram illustrating a circuit 700 for compensating color shift that occurs when performing a color sequential display method according to another embodiment. A difference between the circuit 700 and the circuit 500 is that a gray level generation unit 7022 of the circuit 700 generates zeroth gray levels ZR, ZG, and ZB of red, green, and blue sub-pixels according to a pixel P and a previous pixel LP corresponding to the pixel P received by an image processing unit 702. Then, the gray level generation unit 7022 substitutes the zeroth gray levels ZR, ZG, and ZB of the red, green, and blue sub-pixels into equation (10) to generate first gray levels of red, green, and blue sub-pixels FR, FG, FB. Further, subsequent operational principles of the circuit 700 are the same as those of the circuit 500, so further description thereof is omitted for simplicity.

In addition, in another embodiment of the present invention, the circuit 400, the circuit 500, the circuit 600, and the circuit 700 further include a temperature detector. Therefore, the circuit 400, the circuit 500, the circuit 600, and the circuit 700 can utilize the temperature detector to detect variation of an environmental temperature for adjusting the pure color uniformity U of the display panel 406.

In addition, in another embodiment of the present invention, the circuit 400, the circuit 500, the circuit 600, and the circuit 700 further include a lookup table, where the lookup table is used for recording a relationship between the pure color uniformity U of the display panel 406 and a temperature. Therefore, the circuit 400, the circuit 500, the circuit 600, and the circuit 700 can adjust the pure color uniformity U of the display panel 406 according to variation of an environmental temperature and the lookup table.

Figure 8:
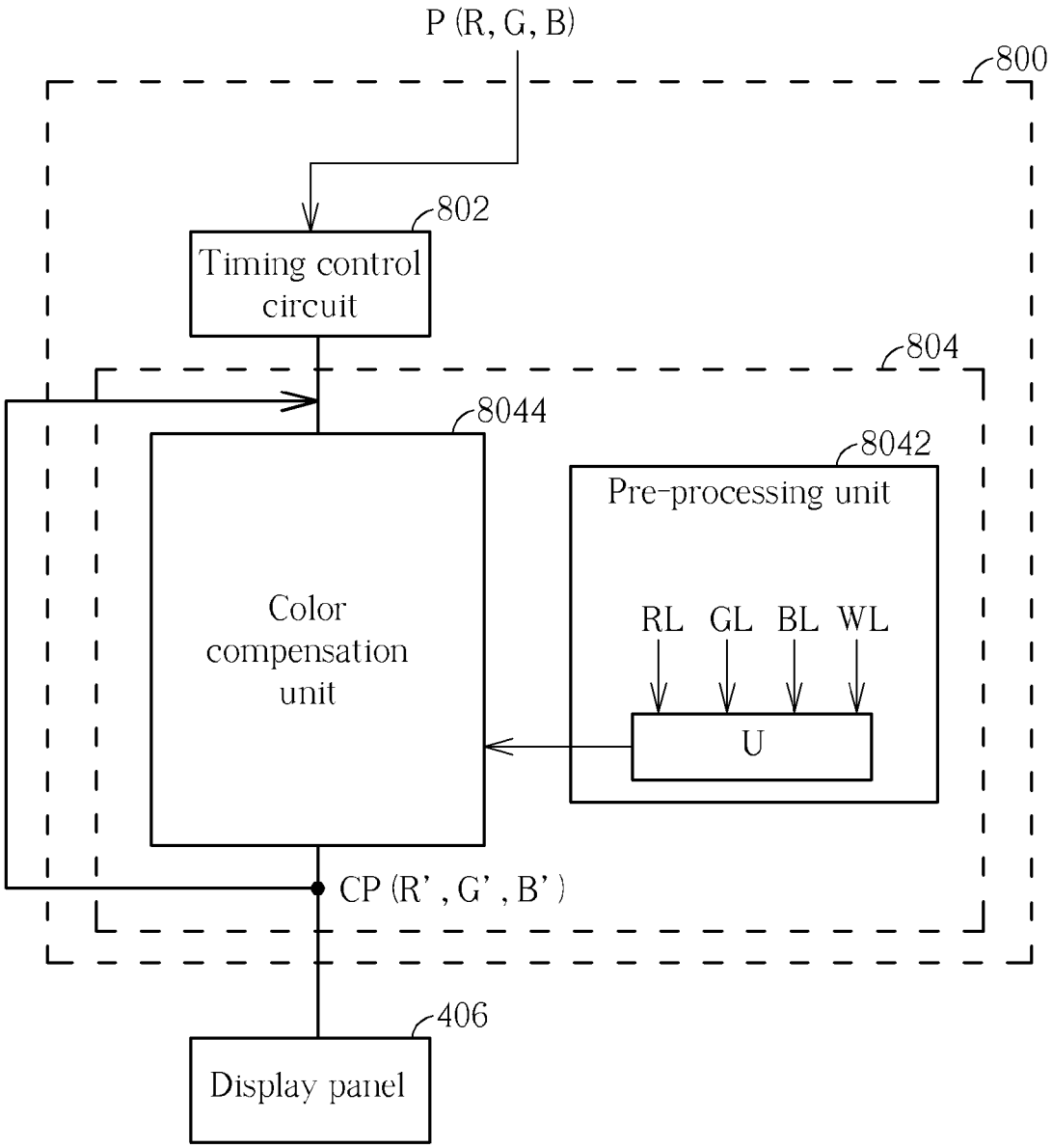
FIG. 8 is a diagram illustrating a circuit for compensating color shift of a color sequential display method according to another embodiment.

Please refer to FIG. 8. FIG. 8 is a diagram illustrating a circuit 800 for compensating color shift that occurs when performing a color sequential display method according to another embodiment. The circuit 800 includes a timing control circuit 802 and an image processing unit 804, where the image processing unit 804 includes a pre-processing unit 8042 and a color compensation unit 8044. The timing control circuit 802 is used for sequencing gray levels R, G, and B of red, green, and blue sub-pixels of a pixel P according to a color sequential display method. The image processing unit 804 is coupled to the timing control circuit 802 for compensating the gray levels R, G, and B of the red, green, and blue sub-pixels of the pixel P to generate compensation gray level values R', G', and B' of the red, green, and blue sub-pixels of the pixel P, and outputting the compensation gray level values R', G', and B' to the display panel 406. The display panel 406 displays the compensated pixel CP according to the compensation gray level values R', G', and B' of the red, green, and blue sub-pixels of the pixel P.

The image processing unit 804 includes the pre-processing unit 8042 and the color compensation unit 8044. The pre-processing unit 8042 is used for generating pure color uniformity U of the display panel 406 according to maximum luminances RL, GL, BL, and WL of red light, green light, blue light, and white light displayed by the display panel 406, and equation (1). The color compensation unit 8044 is coupled to the pre-processing unit 8042 for generating a compensation gray level value of a sub-pixel of the pixel P according to the pure color uniformity U, a gray level of the sub-pixel of the pixel P, and a compensation gray level value of a previous sub-pixel corresponding to the sub-pixel of the pixel P. After the color compensation unit 8044 receives the pure color uniformity U and the gray levels R, G, and B of the red, green, and blue sub-pixels of the pixel P, the color compensation unit 8044 can determine whether a product of the pure color uniformity U and the gray level of the sub-pixel of the pixel P is greater than the compensation gray level value of the previous sub-pixel corresponding to the sub-pixel of the pixel P. That is to say, the color compensation unit 8044 can determine whether a product of the pure color uniformity U and the gray level R of the red sub-pixel of the pixel P is greater than a compensation gray level value of a previous sub-pixel corresponding to the red sub-pixel of the pixel P (that is, a blue sub-pixel of a previous pixel LP corresponding to the pixel P); the color compensation unit 8044 can determine whether a product of the pure color uniformity U and the gray level G of the green sub-pixel of the pixel P is greater than a compensation gray level value of a previous sub-pixel corresponding to the green sub-pixel of the pixel P (that is, the red sub-pixel of the pixel P); the color compensation unit 8044 can determine whether a product of the pure color uniformity U and the gray level B of the blue sub-pixel of the pixel P is greater than a compensation gray level value of a previous sub-pixel corresponding to the blue sub-pixel of the pixel P (that is, the green sub-pixel of the pixel P). When the product of the pure color uniformity U and the gray level of the sub-pixel of the pixel P is smaller than the compensation gray level value of the previous sub-pixel corresponding to the sub-pixel of the pixel P, the color compensation unit 8044 outputs the compensation gray level value of the sub-pixel of the pixel P to the display panel 406 and the color compensation unit 8044 according to equation (12):

$$X'=S\times U \tag{12}$$

As shown in equation (12), X' is the compensation gray level value of the sub-pixel of the pixel P, and S is the gray level of the sub-pixel of the pixel P. When the product of the pure color uniformity U and the gray level of the sub-pixel of the pixel P is greater than the compensation gray level value of the previous sub-pixel corresponding to the sub-pixel of the pixel P, the color compensation unit 8044 outputs the compensation gray level value of the sub-pixel of the pixel P to the display panel 406 and the color compensation unit 8044 according to equation (13):

$$X' = S - \frac{1-U}{U} \times X \tag{13}$$

As shown in equation (13), X' is the compensation gray level value of the sub-pixel of the pixel P, S is the gray level of the sub-pixel of the pixel P, and X is the compensation gray level value of the previous sub-pixel corresponding to the sub-pixel of the pixel P. In addition, the circuit 800 is used for reducing gray levels of a pixel with higher color saturation, and not changing gray levels of a pixel with lower color saturation. Further, because a liquid crystal changes from turned-on to turned-off faster than form turned-off to turned-on, the circuit 800 does not compensate the gray levels of the pixel with the higher color saturation to prevent the gray levels of the pixel with the higher color saturation from being negative when the liquid crystal changes form turned-on to turned-off.

In addition, in another embodiment of the present invention, the circuit 800 further includes a temperature detector. Therefore, the circuit 800 can utilize the temperature detector to detect variation of an environmental temperature for adjusting the pure color uniformity U of the display panel 406.

In addition, in another embodiment of the present invention, the circuit 800 further includes a lookup table, where the lookup table is used for recording a relationship between the pure color uniformity U of the display panel 406 and a temperature. Therefore, the circuit 800 can adjust the pure color uniformity U of the display panel 406 according to variation of an environmental temperature and the lookup table.

Figure 9:
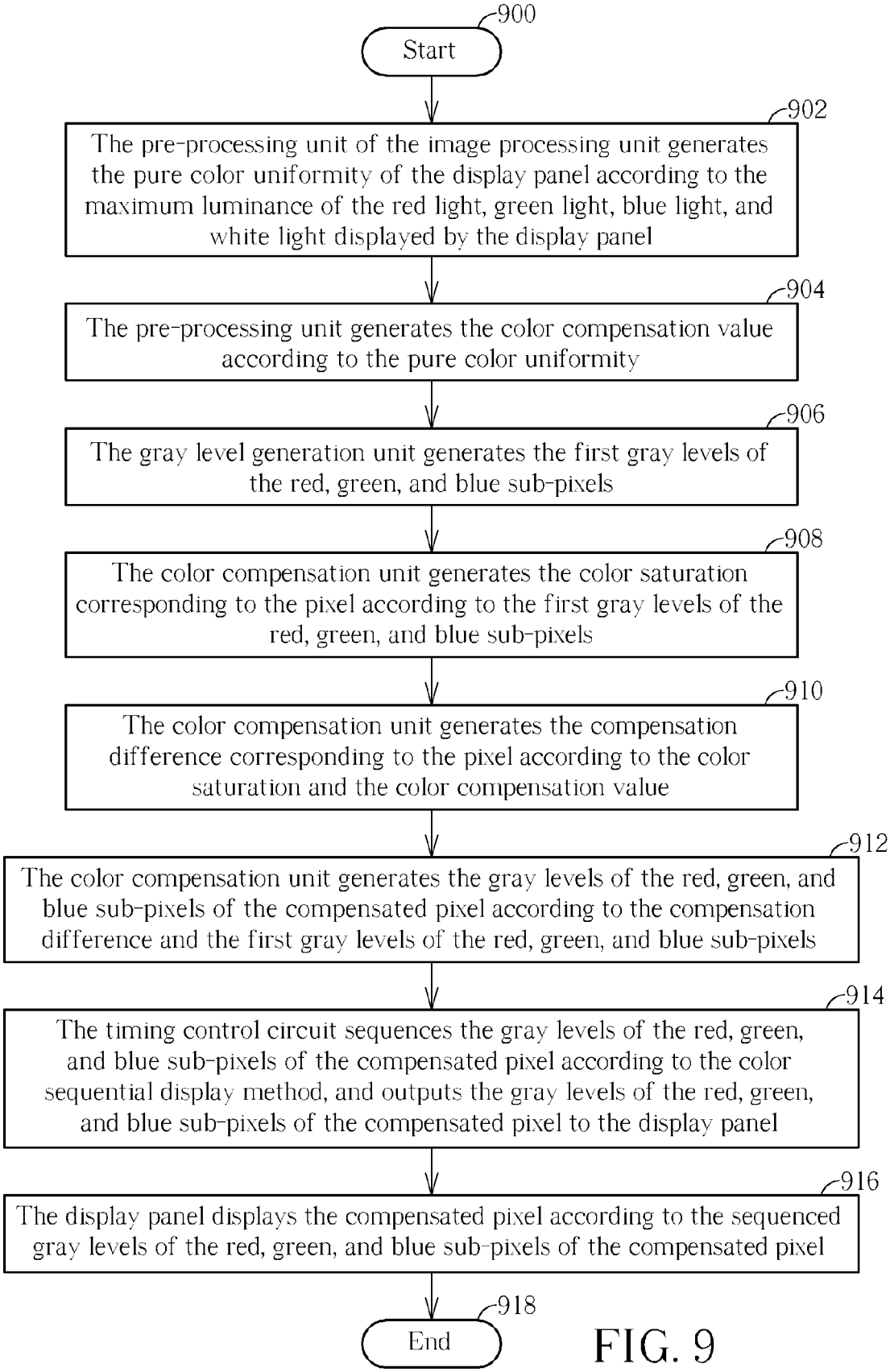
FIG. 9 is a flowchart illustrating a method for compensating color shift of a color sequential display method according to another embodiment.

Please refer to FIG. 9. FIG. 9 is a flowchart illustrating a method for compensating color shift that occurs when performing a color sequential display method according to another embodiment. The method in FIG. 9 is illustrated using the circuit 400 in FIG. 4. Detailed steps are as follows:

Step 900: Start.

Step 902: The pre-processing unit 4024 of the image processing unit 402 generates the pure color uniformity U of the display panel 406 according to the maximum luminance RL, GL, BL, and WL of the red light, green light, blue light, and white light displayed by the display panel 406.

Step 904: The pre-processing unit 4024 generates the color compensation value Q according to the pure color uniformity U.

Step 906: The gray level generation unit 4022 generates the first gray levels FR, FG, and FB of the red, green, and blue sub-pixels.

Step 908: The color compensation unit 4026 generates the color saturation S corresponding to the pixel P according to the first gray levels FR, FG, and FB of the red, green, and blue sub-pixels.

Step 910: The color compensation unit 4026 generates the compensation difference D corresponding to the pixel P according to the color saturation S and the color compensation value Q.

Step 912: The color compensation unit 4026 generates the gray levels R', G', and B' of the red, green, and blue sub-pixels of the compensated pixel CP according to the compensation difference D and the first gray levels FR, FG, and FB of the red, green, and blue sub-pixels.

Step 914: The timing control circuit 404 sequences the gray levels R', G', and B' of the red, green, and blue sub-pixels of the compensated pixel CP according to the color sequential display method, and outputs the gray levels R', G', and B' of the red, green, and blue sub-pixels of the compensated pixel CP to the display panel 406.

Step 916: The display panel 406 displays the compensated pixel CP according to the sequenced gray levels R', G', and B' of the red, green, and blue sub-pixels of the compensated pixel CP.

Step 918: End.

In Step 902, the pre-processing unit 4024 substitutes the maximum luminance RL, GL, BL, and WL of the red light, green light, blue light, and white light displayed by the display panel 406 into equation (1) to generate the pure color uniformity U. In Step 904, the pre-processing unit 4024 substitutes the pure color uniformity U into equation (2) to generate the color compensation value Q. In Step 906, the gray level generation unit 4022 generates the first gray levels FR, FG, and FB of the red, green, and blue sub-pixels according to the pixel P received by the image processing unit 402, where the first gray levels FR, FG, and FB of the red, green, and blue sub-pixels are equal to the gray levels R, G, and B of the red, green, and blue sub-pixels of the pixel P. In Step 908, the color compensation unit 4026 substitutes the first gray levels FR, FG, and FB of the red, green, and blue sub-pixels into equation (4) to generate the color saturation S corresponding to the pixel P. In Step 910, the color compensation unit 4026 substitutes the color compensation value Q corresponding to the pixel P and the color saturation S corresponding to the pixel P into equation (5) to generate the compensation difference D corresponding to the pixel P. In Step 912, the color compensation unit 4026 substitutes the compensation difference D corresponding to the pixel P and the first gray levels FR, FG, and FB of the red, green, and blue sub-pixels into equation (6) to generate the gray levels R', G', and B' of the red, green, and blue sub-pixels of the compensated pixel CP.

In another embodiment of FIG. 9, the gray level generation unit 6022 generates the first gray levels FR, FG, and FB of the red, green, and blue sub-pixels according to the pixel P received by the image processing unit 602 and the previous pixel LP corresponding to the pixel P. That is to say, the gray level generation unit 6022 generates the first gray levels FR of the red sub-pixel according to the gray level R of the red sub-pixel of the pixel P and the gray levels LG, and LB of the green, and blue sub-pixels of the previous pixel LP; the gray level generation unit 6022 generates the first gray levels FG of the green sub-pixel according to the gray level G of the green sub-pixel of the pixel P, the gray level R of the red sub-pixel of the pixel P, and the gray level LB of the blue sub-pixel of the previous pixel LP; the gray level generation unit 6022 generates the first gray levels FB of the blue sub-pixel according to the gray level R of the red sub-pixel of the pixel P, the gray level G of the green sub-pixel of the pixel P, and the gray level B of the blue sub-pixel of the pixel P.

Figure 10:
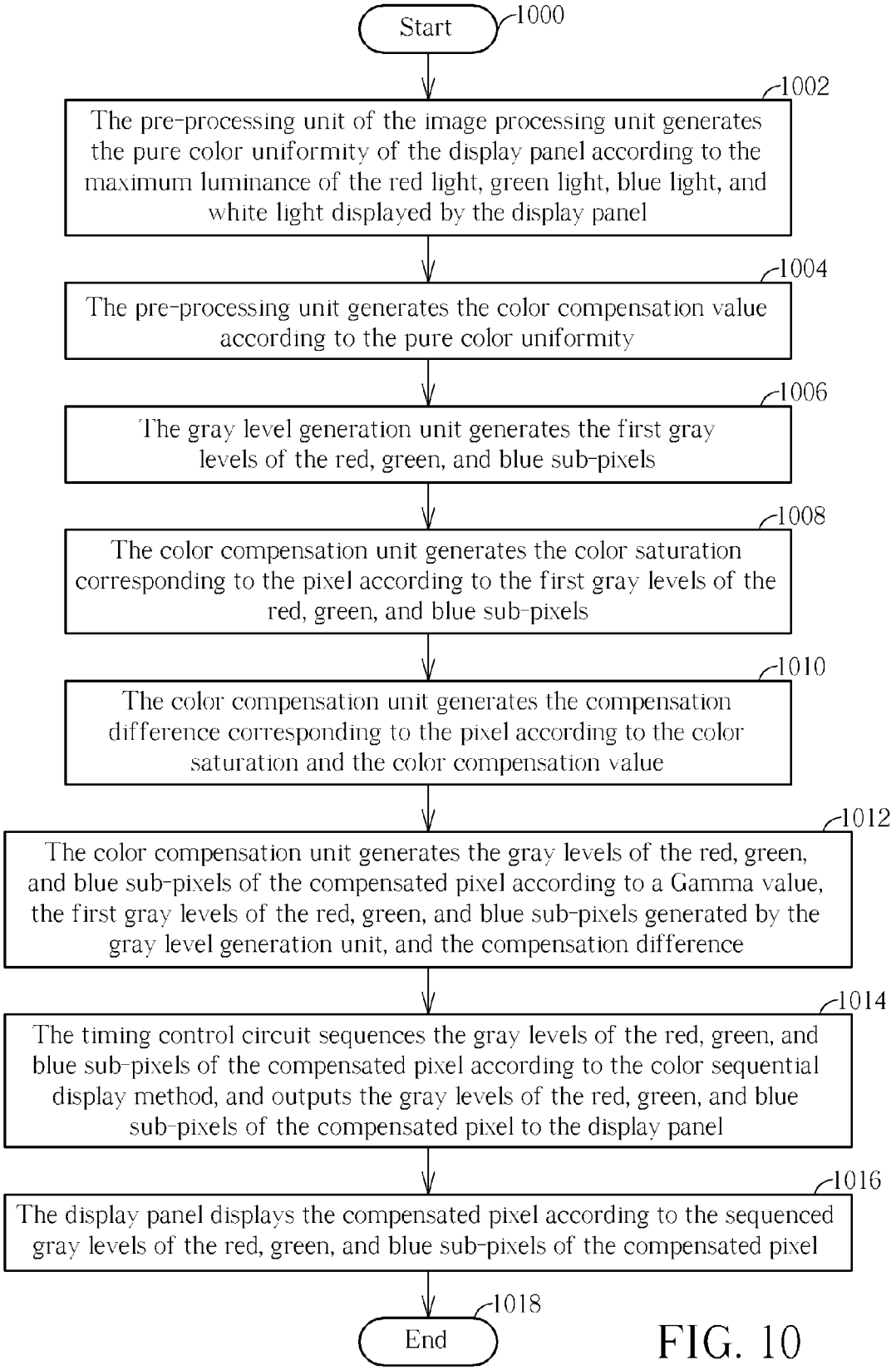
FIG. 10 is a flowchart illustrating a method for compensating color shift of a color sequential display method according to another embodiment.

Please refer to FIG. 10. FIG. 10 is a flowchart illustrating a method for compensating color shift that occurs when performing a color sequential display method according to another embodiment. The method in FIG. 10 is illustrated using the circuit 500 in FIG. 5. Detailed steps are as follows:

Step 1000: Start.

Step 1002: The pre-processing unit 4024 of the image processing unit 502 generates the pure color uniformity U of the display panel 406 according to the maximum luminance RL, GL, BL, and WL of the red light, green light, blue light, and white light displayed by the display panel 406.

Step 1004: The pre-processing unit 4024 generates the color compensation value Q according to the pure color uniformity U.

Step 1006: The gray level generation unit 5022 generates the first gray levels FR, FG, and FB of the red, green, and blue sub-pixels.

Step 1008: The color compensation unit 5026 generates the color saturation S corresponding to the pixel P according to the first gray levels FR, FG, and FB of the red, green, and blue sub-pixels.

Step 1010: The color compensation unit 5026 generates the compensation difference D corresponding to the pixel P according to the color saturation S and the color compensation value Q.

Step 1012: The color compensation unit 5026 generates the gray levels R', G', and B' of the red, green, and blue sub-pixels of the compensated pixel CP according to a Gamma value $\gamma$, the first gray levels FR, FG, and FB of the red, green, and blue sub-pixels generated by the gray level generation unit 5022, and the compensation difference D.

Step 1014: The timing control circuit 404 sequences the gray levels R', G', and B' of the red, green, and blue sub-pixels of the compensated pixel CP according to the color sequential display method, and outputs the gray levels R', G', and B' of the red, green, and blue sub-pixels of the compensated pixel CP to the display panel 406.

Step 1016: The display panel 406 displays the compensated pixel CP according to the sequenced gray levels R', G', and B' of the red, green, and blue sub-pixels of the compensated pixel CP.

Step 1018: End.

In Step 1006, the gray level generation unit 5022 of the image processing unit 502 substitutes the gray levels R, G, and B of the red, green, and blue sub-pixels of the pixel P received by the image processing unit 502 into equation (10) to generate the first gray levels FR, FG, and FB of the red, green, and blue sub-pixels. In Step 1012, the color compensation unit 5026 of the image processing unit 502 substitutes the first gray levels FR, FG, and FB of the red, green, and blue sub-pixels generated by the gray level generation unit 5022 and the compensation differenced D into equation (11) to generate the gray levels R', G', and B' of red, green, and blue sub-pixels of the compensated pixel CP. Further, subsequent operational principles of the embodiment in FIG. 10 are the same as those of the embodiment in FIG. 9, so further description thereof is omitted for simplicity.

In another embodiment of FIG. 10, the gray level generation unit 7022 generates the first gray levels FR, FG, and FB of the red, green, and blue sub-pixels according to the pixel P received by the image processing unit 702 and the previous pixel LP corresponding to the pixel P received by the image processing unit 702. That is to say, the gray level generation unit 7022 generates the zeroth gray levels ZR, ZG, and ZB of the red, green, and blue sub-pixels according to the pixel P and the previous pixel LP corresponding to the pixel P received by the image processing unit 702. Then, the gray level generation unit 7022 substitutes the zeroth gray levels ZR, ZG, and ZB of the red, green, and blue sub-pixels into equation (10) to generate the first gray levels FR, FG, and FB of the red, green, and blue sub-pixels.

In addition, other embodiments of FIG. 9 and FIG. 10 further include utilizing a temperature detector to detect variation of an environmental temperature for adjusting the pure color uniformity U of the display panel 406. Further, other embodiments of FIG. 9 and FIG. 10 further include looking up a relationship between the pure color uniformity U of the display panel 406 and a temperature for adjusting the pure color uniformity U according to the lookup table.

Figure 11:
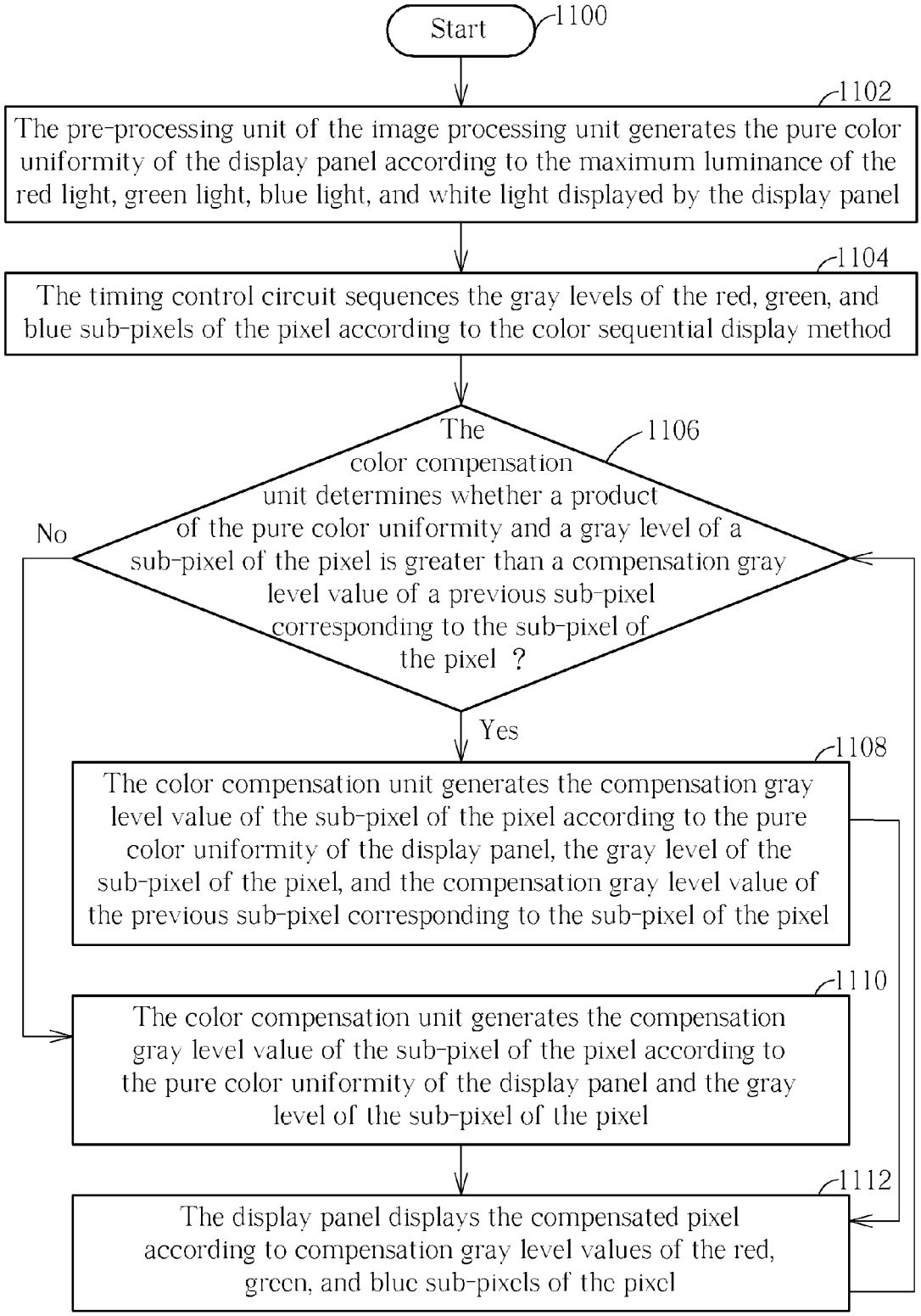
FIG. 11 is a flowchart illustrating a method for compensating color shift of a color sequential display method according to another embodiment.

Please refer to FIG. 11. FIG. 11 is a flowchart illustrating a method for compensating color shift that occurs when performing a color sequential display method according to another embodiment. The method in FIG. 11 is illustrated using the circuit 800 in FIG. 8. Detailed steps are as follows:

Step 1100: Start.

Step 1102: The pre-processing unit 8042 of the image processing unit 804 generates the pure color uniformity U of the display panel 406 according to the maximum luminance RL, GL, BL, and WL of the red light, green light, blue light, and white light displayed by the display panel 406.

Step 1104: The timing control circuit 802 sequences the gray levels R, G, and B of the red, green, and blue sub-pixels of the pixel P according to the color sequential display method.

Step 1106: The color compensation unit 8044 determines whether a product of the pure color uniformity U and a gray level of a sub-pixel of the pixel P is greater than a compensation gray level value of a previous sub-pixel corresponding to the sub-pixel of the pixel P. If yes, go to Step 1108; if no, go to Step 1110.

Step 1108: The color compensation unit 8044 generates the compensation gray level value of the sub-pixel of the pixel P according to the pure color uniformity U of the display panel 406, the gray level of the sub-pixel of the pixel P, and the compensation gray level value of the previous sub-pixel corresponding to the sub-pixel of the pixel P; go to Step 1112.

Step 1110: The color compensation unit 8044 generates the compensation gray level value of the sub-pixel of the pixel P according to the pure color uniformity U of the display panel 406 and the gray level of the sub-pixel of the pixel P; go to Step 1112.

Step 1112: The display panel 406 displays the compensated pixel P according to compensation gray level values R', G', and B' of the red, green, and blue sub-pixels of the pixel P; go to Step 1106.

In Step 1108, the color compensation unit 8044 substitutes the pure color uniformity U of the display panel 406, the gray level of the sub-pixel of the pixel P, and the compensation gray level value of the previous sub-pixel corresponding to the sub-pixel of the pixel P into equation (13) to generate the compensation gray level value of the sub-pixel of the pixel P. In Step 1110, the color compensation unit 8044 substitutes the pure color uniformity U of the display panel 406 and the gray level of the sub-pixel of the pixel P into equation (12) to generate the compensation gray level value of the sub-pixel of the pixel P.

In addition, another embodiment of FIG. 11 further includes utilizing a temperature detector to detect variation of an environmental temperature for adjusting the pure color uniformity U of the display panel 406. Further, another embodiment of FIG. 11 further includes looking up a relationship between the pure color uniformity U of the display panel 406 and a temperature for adjusting the pure color uniformity U according to the lookup table.

To sum up, the circuit for compensating the color shift that occurs when performing the color sequential display method and method thereof adjust gray levels of a pixel according to color saturation of the pixel, and maximum luminances of red light, green light, blue light, and white light of a display panel. Therefore, the present invention can solve a problem of uneven color levels of the display panel due to insufficient response time of liquid crystals of the display panel.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A circuit for compensating color shift of a color sequential display method, the circuit comprising:

an image processing unit for compensating gray levels of red, green, and blue sub-pixels of a pixel to generate gray levels of red, green, and blue sub-pixels of a compensated pixel, the image processing unit comprising:

a gray level generation unit for generating first gray levels of red, green, and blue sub-pixels according to the pixel received by the image processing unit and a first Gamma adjustment equation;

a pre-processing unit for generating a pure color uniformity of a display panel according to maximum luminances of red light, green light, blue light, and white light displayed by the display panel, and generating a color compensation value according to the pure color uniformity; and a color compensation unit coupled to the pre-processing unit and the gray level generation unit for generating a color saturation of the pixel according to the first gray levels of the red, green, and blue sub-pixels generated by the gray level generation unit, generating a compensation difference of the pixel according to the color saturation and the color compensation value, and generating the gray levels of the red, green, and blue sub-pixels of the compensated pixel according to the compensation difference and the first gray levels of the red, green, and blue sub-pixels; and a timing control circuit coupled to the image processing unit for sequencing the gray levels of the red, green, and blue sub-pixels of the compensated pixel according to the color sequential display method, and outputting the gray levels of the red, green, and blue sub-pixels of the compensated pixel to the display panel;

wherein the display panel displays the compensated pixel according to the sequenced gray levels of the red, green, and blue sub-pixels of the compensated pixel.

2. The circuit of claim 1, wherein the gray level generation unit generating the first gray levels of the red, green, and blue sub-pixels is the gray level generation unit generating the first gray levels of the red, green, and blue sub-pixels according to the pixel received by the image processing unit.

3. The circuit of claim 1, wherein the gray level generation unit generating the first gray levels of the red, green, and blue sub-pixels is the gray level generation unit generating the first gray levels of the red, green, and blue sub-pixels according to the pixel received by the image processing unit and a previous pixel corresponding to the pixel.

4. The circuit of claim 1, wherein the first Gamma adjustment equation is $$FR = \left(\frac{R}{255}\right)^{\gamma}$$

$$FG = \left(\frac{G}{255}\right)^{\gamma}$$

$$FB = \left(\frac{B}{255}\right)^{\gamma};$$

wherein:

R, G, and B are the gray levels of the red, green, and blue sub-pixels of the pixel; and FR, FG, and FB are the first gray levels of the red, green, and blue sub-pixels generated by the gray level generation unit.

5. The circuit of claim 1, wherein the color compensation unit generating the gray levels of the red, green, and blue sub-pixels of the compensated pixel is according to a second Gamma adjustment equation, the first gray levels of the red, green, and blue sub-pixels generated by the gray level generation unit, and the compensation difference.

6. The circuit of claim 5, wherein the second Gamma adjustment equation is $$R' = [FR \times (1 - D)]^{\left(\frac{1}{\gamma}\right)} \times 255$$

$$G' = [FG \times (1 - D)]^{\left(\frac{1}{\gamma}\right)} \times 255$$

$$B' = [FB \times (1 - D)]^{\left(\frac{1}{\gamma}\right)} \times 255;$$

wherein:

D is the compensation difference;

FR, FG, and FB are the first gray levels of the red, green, and blue sub-pixels generated by the gray level generation unit; and R', G', and B' are the gray levels of the red, green, and blue sub-pixels of the compensated pixel.

7. The circuit of claim 1, wherein the gray level generation unit generating the first gray levels of the red, green, and blue sub-pixels is according to the pixel received by the image processing unit, a previous pixel corresponding to the pixel, and a first Gamma adjustment equation.

8. The circuit of claim 7, wherein the first Gamma adjustment equation is $$FR = \left(\frac{R}{255}\right)^{\gamma}$$

$$FG = \left(\frac{G}{255}\right)^{\gamma}$$

$$FB = \left(\frac{B}{255}\right)^{\gamma};$$

wherein:

R, G, and B are the gray levels of the red, green, and blue sub-pixels of the pixel; and FR, FG, and FB are the first gray levels of the red, green, and blue sub-pixels generated by the gray level generation unit.

9. The circuit of claim 7, wherein the color compensation unit generating the gray levels of the red, green, and blue sub-pixels of the compensated pixel is according to a second Gamma adjustment equation, the first gray levels of the red, green, and blue sub-pixels generated by the gray level generation unit, and the compensation difference.

10. The circuit of claim 9, wherein the second Gamma adjustment equation is $$R' = [FR \times (1 - D)]^{\left(\frac{1}{\gamma}\right)} \times 255$$

$$G' = [FG \times (1 - D)]^{\left(\frac{1}{\gamma}\right)} \times 255$$

$$B' = [FB \times (1 - D)]^{\left(\frac{1}{\gamma}\right)} \times 255;$$

wherein:

D is the compensation difference;

FR, FG, and FB are the first gray levels of the red, green, and blue sub-pixels generated by the gray level generation unit; and R', G', and B'are the gray levels of the red, green, and blue sub-pixels of the compensated pixel.

11. The circuit of claim 1, wherein the pre-processing unit utilizes a first equation $$U = \frac{RL + GL + BL}{WL}$$

to generate the pure color uniformity U, wherein:

U is the pure color uniformity; and

RL, GL, BL, and WL are maximum luminances of the red light, green light, blue light, and white light displayed by the display panel.

12. The circuit of claim 1, wherein the pre-processing unit utilizes a second equation Q=1−U to generate the color compensation value Q.

13. The circuit of claim 1, wherein the color compensation unit utilizes a third equation $$S = \frac{\max(FR, FG, FB)}{\text{sum}(FR, FG, FB)}$$

to generate the color saturation S, wherein:

S is the color saturation of the pixel;

FR, FG, and FB are the first gray levels of the red, green, and blue sub-pixels generated by the gray level generation unit; and Max(FR, FG, FB) is a maximum gray level of the first gray levels of the red, green, and blue sub-pixels generated by the gray level generation unit.

14. The circuit of claim 1, wherein the color compensation unit utilizes a fourth equation D=Q×(1−S)×C to generate the compensation difference D, wherein:

Q is the color compensation value;

D is the compensation difference; and

C is a constant value chosen by a user.

15. The circuit of claim 1, wherein the color compensation unit utilizes a fifth equation to generate the gray levels of the red, green, and blue sub-pixels R', G', and B'of the compensated pixel, wherein the fifth equation is $$R' = FR \times (1 - D)$$

$$G' = FG \times (1 - D)$$

$$B' = FB \times (1 - D),$$

and FR, FG, and FB are the first gray levels of the red, green, and blue sub-pixels generated by the gray level generation unit.

16. The circuit of claim 1, further comprising:

a temperature detector for adjusting the pure color uniformity according to a temperature.

17. The circuit of claim 1, further comprising:

a lookup table for recording a relationship between the pure color uniformity and a temperature.

* * * * *